US005582269A

United States Patent [19]

Gugel et al.

[11] Patent Number: 5,582,269

[45] Date of Patent: Dec. 10, 1996

[54] LADDER ACCESSORY

[76] Inventors: Leslie H. Gugel; Joyce A. Gugel, both of 161 E. Hampton Way, Jupiter, Fla. 33458

[21] Appl. No.: 413,476

[22] Filed: Mar. 30, 1995

[51] Int. Cl.[6] ..... A47F 5/00

[52] U.S. Cl. ..... 182/129; 248/238

[58] Field of Search ..... 182/129; 248/238, 248/210; 206/372, 373

[56] References Cited

U.S. PATENT DOCUMENTS

| | | | |
|---|---|---|---|
| 4,150,746 | 4/1979 | Buglione | 206/372 |
| 4,569,449 | 2/1986 | Brent | 182/129 X |
| 4,717,020 | 1/1988 | Viira | 216/372 |
| 5,123,620 | 6/1992 | Bourne . | |
| 5,191,954 | 3/1993 | Ledford . | |
| 5,242,050 | 9/1993 | Billings | 206/372 X |
| 5,259,480 | 11/1993 | Bartnicki . | |
| 5,342,008 | 8/1994 | Kay . | |

FOREIGN PATENT DOCUMENTS

| | | | |
|---|---|---|---|
| 421159 | 12/1910 | France | 182/129 |

*Primary Examiner*—Alvin C. Chin-Shue
*Attorney, Agent, or Firm*—McHale & Slavin, P.A.

[57] ABSTRACT

The instant invention is a ladder accessory in the form of a toolbox. The toolbox is coupled to support brackets mounted on each front leg of a conventional ladder. The toolbox includes a handle that allows for securing to the brackets when the cover is opened by forcing pinions located in the bottom of the box through pinion apertures located on each support bracket. The support bracket allows lifting of the toolbox so as to provide a safe working area for a worker on top of the ladder allowing ease of access to the necessary tools in order to accomplish a particular task. Bracket release levers are provided on each support bracket to allow lifting of the toolbox in a convenient manner.

12 Claims, 3 Drawing Sheets

LADDER ACCESSORY

FIELD OF THE INVENTION

This invention relates to ladders and more particularly to a removable ladder top accessory.

BACKGROUND OF THE INVENTION

Step ladders are used to perform tasks at an elevated stance. Conventional ladders are based on a collapsible A-frame structure having support rails that hold individual rungs allowing a person to climb up or down the structure so as to position themselves at various heights. The top portion includes a provision for pivoting the ladder support legs from a storage position wherein the legs are parallel to the A-frame stance.

While the primary intent of a ladder is to perform work at an elevated position, a problem arises from the lack of working space available to support tools. Although not the intended purpose, a top rung is commonly used to support working materials lessening the need to leave the ladder in order to obtain the necessary tools to perform a task. The top of the ladder may include holes or brackets for holding tools such as hammers, screw drivers and electric drills.

A paint tray platform may also be used to support items but is designed to support a conventional roller paint tray. Attempts to use the paint tray support platform for support of heavy items is dangerous. In light of the lack of surface area to support items needed while on a step ladder, prior art devices have been patented in an attempt to address the problem.

U.S. Pat. No. 5,123,620 discloses an accessory container for a ladder that mounts over the top of the ladder. The device is a single piece container that looks like a bucket and effectively provides an area for tools. The problem with the device is the necessity for removing the accessory when not in use, thus defeating the compactness of the conventional ladder.

U.S. Pat. No. 5,191,954 discloses a platform having support brackets that attach directly to the steps of a conventional aluminum ladder. The support structure relies upon the use of the hollow rungs that are spaced apart a predetermined distance so as to allow support of a back piece that also must be stored separately during storage.

U.S. Pat. No. 5,259,480 discloses an actual ladder top modified to accept various tools or hanging devices by use of a multi-function platform. Provisions are made for the device to replace the existing ladder top or attach directly to the existing ladder top.

U.S. Pat. No. 5,342,008 discloses yet another support platform that can be positioned anywhere along the longitudinal length of a ladder. This teaching requires a special shaped ladder having a handle area that extends above the top of the conventional A-frame support.

Thus, a problem with the prior art is that ladders have an insufficient work area available for support of materials while working on the ladder. For these reasons it would be most beneficial to have a ladder with an accessory to support various working materials.

SUMMARY OF THE INVENTION

The instant invention is an accessory for a conventional ladder that operates as a utility or toolbox for holding various items in a stable position at the top of a ladder. The accessory replicates a conventional toolbox having a bin with four side walls. A cover to the bin includes a latch mechanism for securely holding any item placed in the bin. A handle is provided for transportation purposes. Unique to the toolbox is its ability to attach to a ladder in combination with brackets allowing the toolbox to be elevated over the top of the ladder.

The brackets consist of parallel disposed legs attached to each side surface of a ladder. A release lever includes a provision to allow the raising or lowering of the brackets to match the preferred operating height of a person standing on the ladder. The brackets accept the toolboxes of the instant invention which have pinions to engage each bracket. The pinions secure the toolbox between the brackets when the cover of the toolbox is open. The pinions are spring biased and positioned along each corner of the toolbox.

In operation, a worker may use the toolbox in its conventional manner. When a ladder is needed to work at an elevated height the worker places the toolbox on the top rung of the ladder having the aforementioned brackets. The cover latch is released and the cover opened therein allowing the pinions to project outwardly from the toolbox into pinion receptacles on each bracket. With the toolbox secured to the brackets, the worker may climb the ladder and raise the toolbox by lifting the brackets by grasping the handle on each bracket allowing for the slidable extension above the surface of the ladder.

Thus, an objective of the instant invention is to disclose an adjustable utility box for placement on top of a conventional ladder wherein the box may accommodate articles being raised to various heights providing operator safety and convenience.

Still another objective of the instant invention is to disclose a toolbox that may be used in a conventional manner and engages brackets upon the lifting of the cover to secure the toolbox to the ladder.

Yet still another objective of the instant invention is to disclose a bracket kit for attachment to a ladder providing a raisable device for holding items therebetween.

Yet still another objective of the instant invention is to disclose a toolbox having a multi-purpose cover that further operates as a horizontal tray for positioning of items therein.

Other objectives and advantages of this invention will become apparent from the following description taken in conjunction with the accompanying drawings wherein are set forth by way of illustration and example certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention is to be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
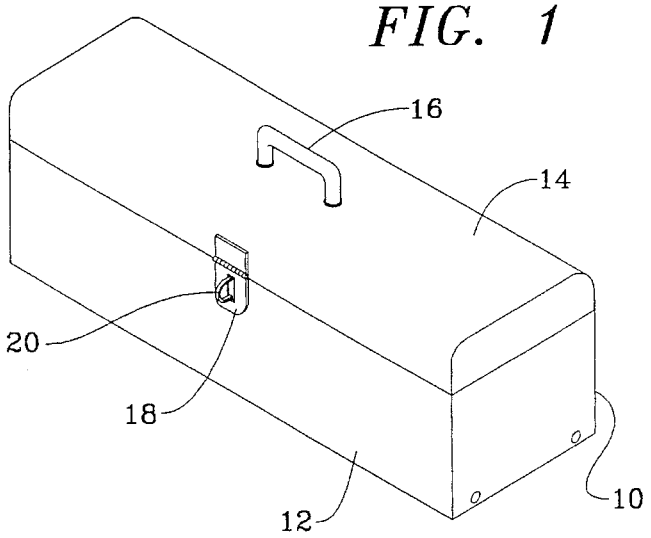
FIG. 1 is a perspective view of the toolbox.

Now referring to FIG. 1, shown is a toolbox 10 having a bin 12 and cover 14. Handle 16 is attached to the cover allowing the toolbox 10 to be carried. Hasp 18 attached to the cover for placement over hook 20 maintains the cover in a closed position when the toolbox is moved. A lock may be placed between the hook 20 and the hasp 18 to prevent access to the contents of the toolbox. It should be noted that the style of box is not critical to this invention which is directed to the idea of elevating a toolbox above the surface of a ladder.

Figure 2:
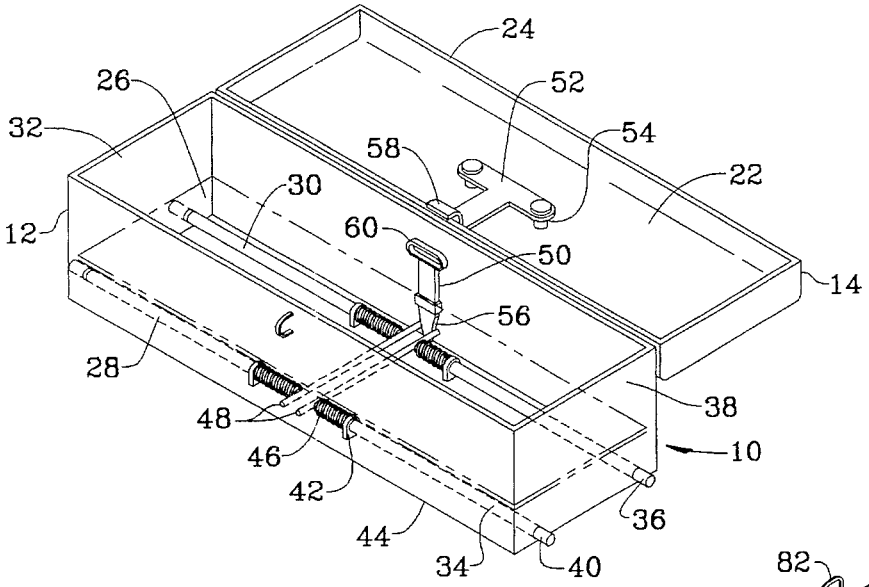
FIG. 2 is a perspective view of FIG. 1 illustrating the toolbox in an open position and the latching mechanism incorporated the rein.

Referring to FIG. 2 the toolbox 10 is shown with cover 14 placed in an open position. The cover has an inner surface 22 which is positioned in a horizontal plane parallel to a bin 12 of the toolbox 10 providing a tray area allowing items to be placed thereon. Side wall 24 prevents the items from sliding off. The toolbox includes a bottom plate 26 which conceals a locking mechanism consisting of pinions 28 and 30 which extend through a side surface 32 of the box with pinions 34 and 36 extending through a second side surface 38. The pinions are redundant in operation as shown by pinion 34 which extends through aperture 40 of side surface 38 having internal surface support 42 maintaining the pinion 34 a fixed distance from bottom surface 44 allowing spring 46 to move freely along one end of the pinion 34. Parallel disposed separating rods 48 are operated by lever 50 which engages an inner support 52 for the handle which is biased a raised distance from surface 22 by springs 54. When the cover is in an open position the lever 50 has an angular base 56 which engages an inner surface of separating rods 48 biasing pinions 28, 30, 34, and 36 in an outward position as shown by 34. The pinions operate similarly and detail is not repeated for the remaining pinions to maintain clarity to the drawing.

When the cover 14 is placed in a closed position latch 58 engages lever opening 60. Lifting of handle 16 causes inner support 52 to be compressed against springs 54 which in turn causes latch 58 to be raised, now coupled to opening 60, lifting lever 50. Angular portion 56 is drawn between the two separating rods 48 with spring 46 biasing against support 42 forcing pinion 34 inwardly from aperture 40 thereby disengaging the toolbox from support brackets and allowing the toolbox to be moved accordingly.

Figure 3:
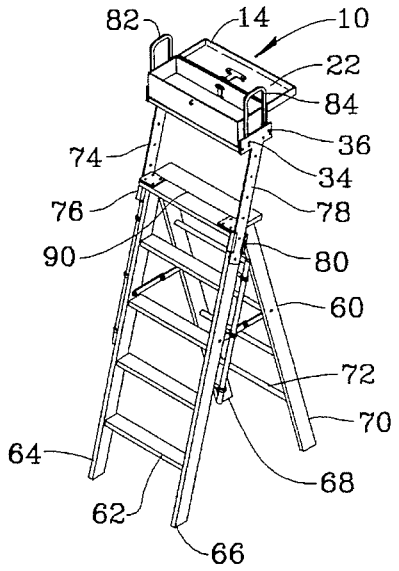
FIG. 3 is a perspective view of a ladder having the toolbox attached to the bracketry of the ladder.

As shown in FIG. 3, ladder 100 includes step rung 62 with spaced apart front ladder legs 64 and 66. The ladder 100 is a conventional A-structure frame having a rear support provided by legs 68 and 70 separated by rungs 72. As described later in this specification, brackets 74 are attached to ladder leg 64 by coupling bracket 76 with a mirror image bracket 78 coupled to ladder leg 66 by bracket 80. Bracket 74 and 78 include handles 82 and 84 respectively. The support bracket provides a means for raising the brackets by grasping handles 82 and 84 having a release mechanism, not shown, which simply allows the handles 82 and 84 to be raised simultaneously by releasing an engagement tab which locks the brackets. Toolbox 10 is shown in a raised position with cover 14 in an open position, pinions 34 and 36 extend through bracket 78 securing the toolbox 10 to the bracket.

By way of operation, bracket 74 and 78 are lowered to a preset position adjacent upper surface 90. Toolbox 10 can be carried to the ladder and placed upon upper surface 90. The handle is folded and cover 14 is unlatched from hasp and opened which compresses the springs causing the pinions to be driven outward through the side surfaces of the toolbox so as to engage receptive apertures located on brackets 74 and 78. An operator may then climb the rungs 72 of the ladder and by grasping handles 82 and 84, raise the toolbox to a comfortable position. It is noted that brackets 74 and 78 are set at the same angular direction as ladder legs 64 and 66 which provides the operator sufficient area so as to use the ladder in a conventional manner, yet provide a raised support for access to tools. As previously mentioned, surface 22 of the toolbox is maintained in a flat horizontal position allowing the operator additional surface area in which to place various items.

Figure 4:
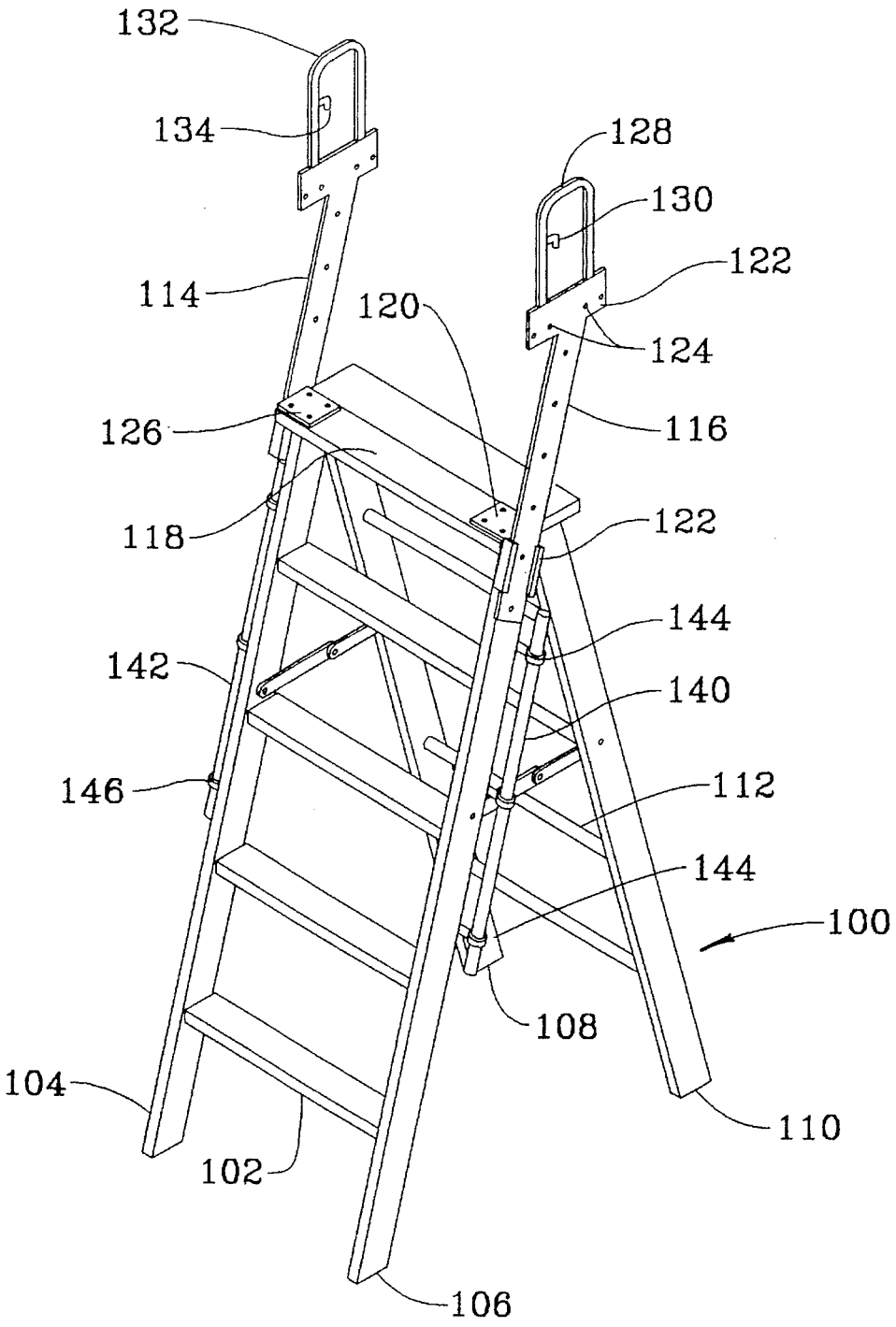
FIG. 4 is a perspective view of the ladder illustrating the bracket kit of the instant invention.

Referring to FIG. 4, shown is a conventional ladder 100 having step rungs 102 spaced apart with ladder legs 104 and 106. The ladder 100 is a conventional A-structure frame having a rear support provided by legs 108 and 110 separated by horizontal support structures 112. Support brackets 114 and 116 are used to support the toolbox of the instant invention over the upper surface 118 of the ladder 100. Bracket 116 is coupled to the upper surface 118 and ladder leg 106 by angle bracket 120 having a first horizontal portion for attachment to the upper surface 118 and is secured to the platform by a plurality of fasteners such as wood screws. Support bracket 122 is secured in a parallel position to ladder leg 106 having formed a cradle for the slidable insertion of bracket 116. An upper portion of the support bracket 122 includes through holes 124 for insertion of pinions from the toolbox. Similarly, bracket 114 is mounted to the ladder by support 126 which is coupled to the upper surface 118 and outside of ladder leg 104 in a similar manner as bracket 120 by use of fasteners such as wood screws. The top portion of bracket 116 includes a handle 128 which allows for ease of grasping the bracket for purposes of lifting and lowering the bracket and associated toolbox, as necessary. Release latch 130 operates in conjunction with bracket 120 to allow the slidable insertion of bracket portion 116 through channel 122. Similarly, the second bracket 114 includes handle 132 with release lever 134 allowing for the raising and lowering of bracket 114 in a horizontal position allowing for the raising and lowering of the toolbox while maintaining the toolbox in a horizontal plane in respect to upper surface 118. It should be noted that bracket 116 cannot be raised higher than bracket 114 when a toolbox is placed therebetween as the toolbox would cause one bracket to crimp within its respective support channel thereby requiring the brackets to be lowered and raised simultaneously. To further assist a worker side rails 140 and 142 are coupled to each front leg by use of support brackets 144 and 146.

Figure 5:
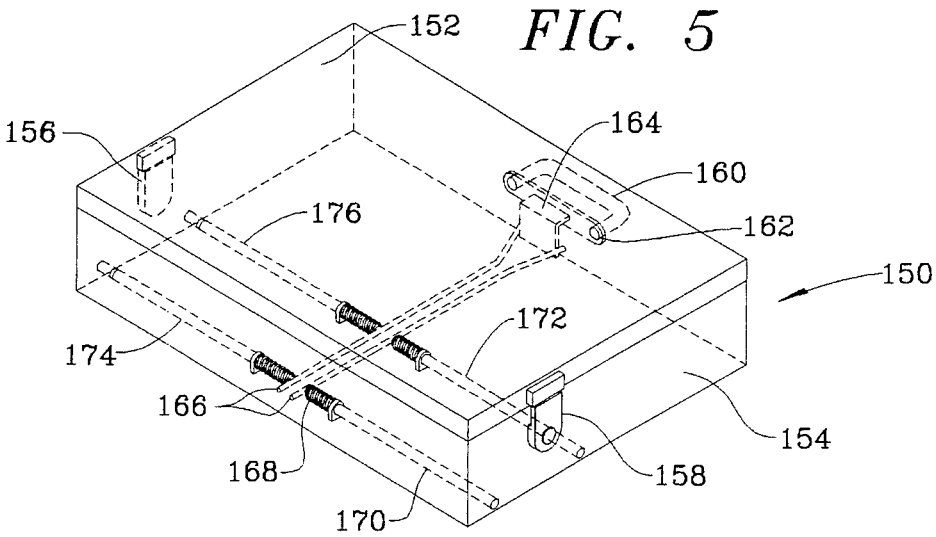
FIG. 5 is a perspective view of a compartmentalized toolbox illustrating the locking mechanism.

Now referring to FIG. 5, shown is an alternative embodiment of the instant invention defining a multi-compartment box. The compartment box 150 has a cover 152 situated over a bin 154. Hasps 156 and 158 operate as hasps to maintain the cover in a closed position. Handle 160 is used to carry the box 150 in the ordinary and conventional manner. When the handle 160 is turned sideways it will depress springs 162 causing engagement plate 164 to be moved outwardly along spacer bars 166 causing springs 168 as on pinion 170 to push outward through side wall of bin 154. Pinions 172, 174 and 176 operate in a similar manner, each having their own springs biased from separated spacer bars 166. When the cover is closed pinions 170, 172, 174, and 176 are retracted allowing the box 150 to be removed from the ladder. Hasps 156 and 158 are located on each side surface allowing the box to be placed on its end in the form of an attache case.

Figure 6:
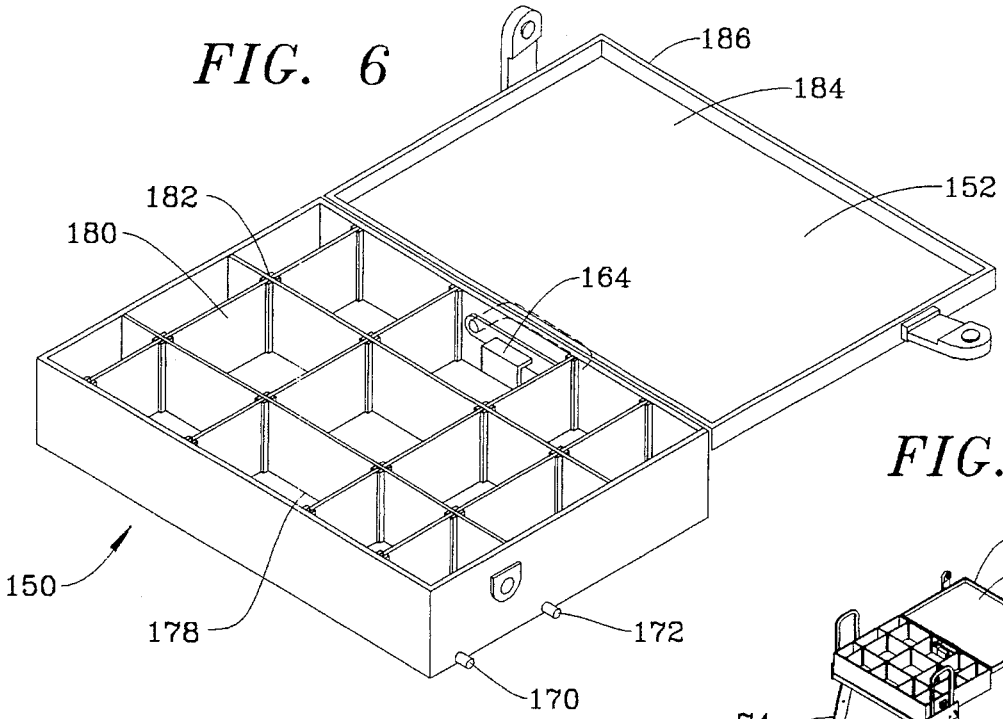
FIG. 6 is a perspective view of the compartmentalized toolbox set forth in FIG. 5 placed in an open position.

Referring to FIG. 6, the box 150 is shown with the cover 152 in an open position revealing inner surface 184 defined by side wall 186. A plurality of compartments 178 are set further in the bin and can be adjusted in size by movement of individual spacer plates 180 which fit into union connectors 182. In the open position, engagement plate 164 is allowed to move inwardly wherein spacer bars 166, as shown in FIG. 5, are inserted allowing the pinions to project outwardly as provided by their respective biasing springs.

Figure 7:
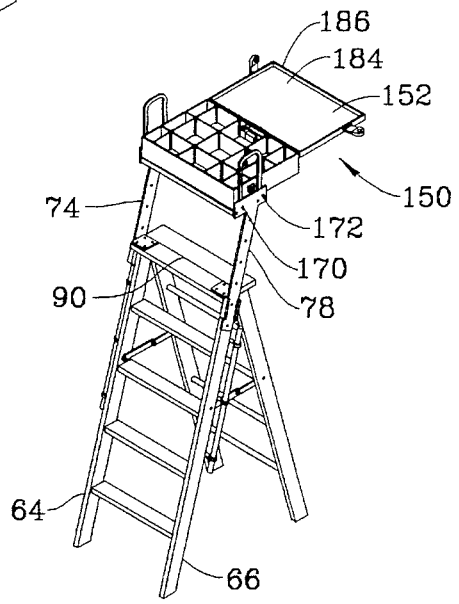
FIG. 7 is a perspective view of a ladder having the bracketry with the compartmentalized toolbox secured thereto.

Referring to FIG. 7, set forth is a conventional A-framed ladder as previously described having brackets 74 and 78 coupled to each front ladder leg 64 and 66. Box 150 is attached to the brackets in a raised position wherein pinions 170 and 172 are inserted through bracket apertures allowing for the support of the box in a raised position a distance above upper surface 90 for the convenience and safety of the operator. Cover 152 has surface 184 which is maintained in a horizontal plane in relation to the lower portion of the box with a raised lip 186 provided around the peripheral of the surface 184 allowing additional surface area for placement of items which are prevented from rolling off the surface by the raised lip 186. As previously described, box 150 is installed by placement upon upper surface 90 while bracket 74 and 78 are in a lowered position. To prevent accidental dislodgment, the handle 160 is set at the rear of the box, as shown, preventing the worker from removing the box while on the ladder. It is my desire to require the box to be lowered to the upper surface 90 wherein the operator would walk to the rear of the ladder for rotation of the handle to a position that will retract pinion bars from their respective engagement to brackets 74 and 78.

It is to be understood that while we have illustrated and described certain forms of my invention, it is not to be limited to specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A toolbox for securing to a ladder comprising: a base portion forming a bin with an open top; a cover portion having a top surface hingedly attached to said base, said base and said cover portion having complementary mating surfaces; latch means to hold said cover portion closed on said base; handle means; a plurality of pinons mounted along an inner surface of said base having a means for projecting said pinons outwardly through opposing side surfaces of said base for securing said base portion to a ladder.

2. The toolbox according to claim 1, wherein said handle means includes a bracket for coupling to said pinions, said bracket allowing for the retraction of said pinions upon the lifting of said handle means for disengaging from the ladder.

3. The toolbox according to claim 1 including a panel for concealment of said pinons.

4. A toolbox comprising: a base portion forming a bin having a plurality of compartments with an open top; a cover portion having a top surface hingedly attached to said base, said base and said cover portion having complementary mating surfaces; latch means to hold said cover portion closed on said base; a plurality of pinons mounted along an inner surface of said base and a means for projecting said pinons outwardly through opposing side surfaces of said base; a bottom juxtapositioned above said pinions providing a support surface in said bin; handle means position on a side wall of said bin; and a bracket means securable to a ladder; wherein said pinion means secures said toolbox to said bracket means.

5. A toolbox comprising: a base portion forming a bin with an open top; a cover portion having a top surface hingedly attached to said base, said base and said cover portion having complementary mating surfaces; latch means to hold said cover portion closed on said base; a plurality of pinons mounted along an inner surface of said base and a means for projecting said pinons outwardly through opposing side surfaces of said base; handle means; and a bracket means securable to a ladder; wherein said pinion means secures said toolbox to said bracket means.

6. The toolbox according to claim 5 wherein said bin includes a plurality of compartments formed by movable separating tabs.

7. The toolbox according to claim 5 wherein each said pinon includes a biasing spring for retracting said pinons inwardly, each said biasing spring is compressed when said cover is in an open position.

8. The toolbox according to claim 5 including a concealment panel disposed above said pinions providing a support surface in said bin.

9. The toolbox according to claim 5 wherein said bracket means is further defined as parallelly disposed rigid supports positionable on each side surface of a ladder, said rigid supports including a mounting means for slidably securing to a ladder.

10. The toolbox according to claim 9 wherein said brackets includes pinion apertures for receipt of said pinions.

11. The toolbox according to claim 9 wherein each said bracket includes a handle means for manual lifting of each said bracket.

12. The toolbox according to claim 10 wherein said handle means includes a release lever operatively associated with each said mounting means wherein operation of said release lever allows for the disengagement from said mounting means permitting the slidable raising and lowering of each said bracket.

* * * * *